US010099875B2

(12) United States Patent
Wagner

(10) Patent No.: US 10,099,875 B2
(45) Date of Patent: Oct. 16, 2018

(54) FEED APPLIANCE FOR FEEDING PRODUCTS ONTO A FURTHER-PROCESSING APPLIANCE

(71) Applicant: Ferag AG, Hinwil (CH)

(72) Inventor: Matthias Wagner, Wetzikon (CH)

(73) Assignee: FERAG AG, Hinwil (CH)

( * ) Notice: Subject to any disclaimer, the term of this patent is extended or adjusted under 35 U.S.C. 154(b) by 0 days.

(21) Appl. No.: 15/605,440

(22) Filed: May 25, 2017

(65) Prior Publication Data

US 2017/0341887 A1 Nov. 30, 2017

(30) Foreign Application Priority Data

May 30, 2016 (CH) ..... 692/16

(51) Int. Cl.
*B65H 5/08* (2006.01)
*B65H 5/12* (2006.01)
(Continued)

(52) U.S. Cl.
CPC ..... *B65H 5/085* (2013.01); *B65H 5/006* (2013.01); *B65H 5/12* (2013.01); *B65H 29/003* (2013.01); *B65H 29/005* (2013.01)

(58) Field of Classification Search
CPC ..... B65H 5/085; B65H 5/12; B65H 29/003; B65H 29/005
(Continued)

(56) References Cited

U.S. PATENT DOCUMENTS 2,848,226 A * 8/1958 Buttner ..... B65H 5/085 271/12
3,032,341 A 5/1962 Reist
(Continued)

FOREIGN PATENT DOCUMENTS

CH 382768 10/1964
DE 10 2011 116 086 4/2013
(Continued)

OTHER PUBLICATIONS

Switzerland Search Report dated Aug. 9, 2016, Application No. CH 00692/16, 2 pages.
(Continued)

*Primary Examiner* — David H Bollinger
(74) *Attorney, Agent, or Firm* — Rankin, Hill & Clark LLP

(57) ABSTRACT

A feed appliance for feeding products to a further processing appliance includes a standby circulatory apparatus with a takeover station and with several transport units that are circulatorily movable independently of one another for each receiving a product at the takeover station, a provision conveyor for feeding the products to the takeover station, and a control device for controlling the feed of the products and of the transport units into a takeover section of the takeover station and for controlling the takeover of the fed products by the transport units. The standby circulatory apparatus for creating a gapless product stream includes a release device for the cyclically controlled release of individual transport units into the takeover section. For this, the control device is designed to release a transport unit only given a feed of a cyclically correct product into the takeover section.

21 Claims, 6 Drawing Sheets

(51) Int. Cl.
*B65H 5/00* (2006.01)
*B65H 29/00* (2006.01)

(58) Field of Classification Search
USPC ..... 271/204, 3.18
See application file for complete search history.

(56) References Cited

U.S. PATENT DOCUMENTS

| | | | | |
|---|---|---|---|---|
| 4,201,286 | A | 5/1980 | Meier | |
| 5,261,520 | A | 11/1993 | Duke | |
| 6,003,859 | A | 12/1999 | Reist | |
| 6,019,047 | A | 2/2000 | Klaas et al. | |
| 6,270,076 | B1 * | 8/2001 | Reist | B65H 29/003 271/204 |
| 2008/0067740 | A1 * | 3/2008 | Keane | B65H 29/003 271/277 |
| 2012/0090958 | A1 * | 4/2012 | Keller | B65H 29/003 198/617 |
| 2015/0151929 | A1 * | 6/2015 | Aumann | B65B 61/20 198/803.3 |
| 2016/0159595 | A1 * | 6/2016 | Dax | B65H 5/085 271/3.24 |
| 2016/0257522 | A1 * | 9/2016 | Keller | B65H 39/10 |

FOREIGN PATENT DOCUMENTS

| | | |
|---|---|---|
| EP | 1 146 000 | 10/2001 |
| EP | 2 700 599 | 2/2014 |
| EP | 3 064 453 | 9/2016 |
| GB | 966402 | 8/1964 |
| WO | 2008/000099 | 1/2008 |
| WO | 2008/119192 | 10/2008 |

OTHER PUBLICATIONS

Extended European Search Report dated Oct. 18, 2017, Application No. EP 17 17 1604, 7 pages.

* cited by examiner

FEED APPLIANCE FOR FEEDING PRODUCTS ONTO A FURTHER-PROCESSING APPLIANCE

BACKGROUND OF THE INVENTION

Field of the Invention

The invention lies in the field of conveying technology and relates to a feed appliance for feeding individual products to a further-processing appliance. The invention moreover relates to a method for creating a gapless product stream from individual products by way of the feed appliance mentioned above.

Description of Related Art

Greater demands are being placed upon the processing of printed products in the course of increasing personalisation (customisation) and regionalisation of the contents of the printed products and in particular of the contents of advertising supplements.

Thus, there is an increasing desire nowadays to no longer scatter printed advertising in a widespread manner by way of mass dispatch, but to direct such printed advertising in a targeted manner to a specific circle of addressees. This follows the trend that has already been established in the field of online advertising.

The trend towards personalised advertising has been encouraged by the fact that, due to the increasing use of the internet by a broad spectrum of the population, companies nowadays have much more information on the purchasing behaviour, the interests, as well as personal details, such as age or sex, concerning individual users or users groups, than was previously the case.

This information is not only used by companies in the field of personalised online adverting, but also increasingly in the field of personalised printed advertising.

Moreover, the advancing digitalisation and automation of working procedures in the field of print processing also increases the possibilities in the field of personalised printed products.

Advertising means, for example, can be applied more efficiently by way of addressee-specific advertising, since the effect of the advertising fizzles out to a much lesser extent compared to mass advertising. Moreover, personalised advertising is more attractive to the addressees than impersonal mass advertising, which often lands in the rubbish bin without even being looked at.

For example, it is known to compile personalised collections of printed products, in particular of advertising material, by way of a collecting device. The complied collections are inserted, for example, in printed products such as newspapers or magazines or processed into a dispatch unit.

However, the error tolerance on preparing or compiling personalised printed products has greatly reduced with the trend towards the personalisation of printed products.

Whereas it is indeed tolerable now and then for a printed product not to be fed or fed twice or for the printed product to be faulty, for example with the mass dispatch of impersonal advertising, the error tolerance with personalised advertising however is much smaller as far as this concerned.

This fact needs to be taken into account in the critic regions of print processing, by way of process courses which are as error-free as possible.

With advertising supplements, these are printed products, which are not critical with regard to time and which can accordingly be produced beforehand.

Thus, it is common to pre-manufacture the printed products, which are not critical with regard to time, such as the mentioned advertising supplements and to store them in an intermediate store until they are processed further.

The time-insensitive printed products are then fetched again from the intermediate store and supplemented to the main product or brought together with the main product into a dispatch unit, on creating the time-critical main product such as newspaper or magazine.

Thus, for example, it is known to pull such intermediately stored printed products from a stack or to unroll them from a roll, and to feed them to the further processing as a product stream.

The published documents EP-A-2 700 599 and WO 2008/000099, for example, describe such an appliance for detaching printed products from a stack and bringing them into a product stream.

The published document CH 382 768 moreover describes a device for feeding printed products to a rotation printing machine. The device includes a circulatory apparatus, which is designed as gravity conveyor and which has a multitude of individual carriages rolling along a guide rail via runner rollers, wherein each individual carriage includes a gripper for gripping and holding a printed product. The individual carriages are released in bar-controlled manner for the takeover of a printed product. The device moreover includes a light-electrical sensor device. The release of an individual carriage is effected on detecting an interruption of a measuring light beam produced by the light-electrical sensor device by the printed product conveyed into the takeover region.

Irregularities on fetching the printed products from an intermediate store, in particular on pulling the printed products from a stack cannot be ruled out, depending on the characteristics of the printed product, so that the product stream has missing printed products, incorrectly positioned printed products or faulty printed products.

It is therefore the object of the present invention, to suggest a feed appliance of the initially mentioned type, by way of which a gapless product stream of individual products can be formed for delivery to a further-processing appliance.

According to a further object, the feed appliance should ensure that a product can always be delivered to the further-processing appliance on demand, so that no cycle gaps are formed in the further-processing appliance.

According to a further object, the product stream should ideally consist of error-free products, so that ideally only error-free products are processed further in the further-processing appliance.

The feed appliance includes a standby circulatory apparatus with a takeover station and with several transport units, which are circulatorily movable independently of one another for each receiving a product at the takeover station.

The feed appliance moreover includes a provision conveyor for feeding the products to the takeover station, as well as a control device for controlling the feed of the products and of the transport units into a takeover section of the takeover station and for controlling the takeover of the fed products by the transport units.

According to a first aspect of the invention, the standby circulatory apparatus includes a release device for the cyclically controlled release of individual transport units into the takeover section, for creating a gapless product stream, wherein the control device is designed to release a takeover unit only given the feed of a cyclically correct product into the takeover section.

In contrast, if a product, which is not cyclically correct, hereinafter also called error product is ascertained, then the control device is designed so as to release no transport unit into the takeover section in the takeover cycle of the error product. Accordingly, no transport unit is conveyed into the takeover section in the takeover cycle of the error product.

An error product in particular is to be understood as a product, which is absent in the product stream of the provision conveyor or one which is incorrectly conveyed or faulty.

A product that is incorrectly conveyed can, for example, be a surplus product or a product that is wrongly positioned in the product stream. Surplus products in a product stream are present if, e.g., several products are simultaneously separated from the stack within an operating cycle.

A faulty product, for example, can be a damaged product, a wrong product or an incomplete product.

The products in particular are flat, flexible products. The products in particular are flexible.

If the feed device according to the invention is to be applied in print processing, then the products are printed products.

The printed products can be newspapers, magazines, periodicals, brochures, advertising supplements, individual sheets, leaflets, fliers and advertising brochures in the broadest sense.

The standby circulatory apparatus serves for creating a gapless stream of products from products fed individually from the provision conveyor, for delivery to a further-processing appliance connecting to the standby circulatory apparatus.

The further-processing appliance can e.g. include a collecting device with a collecting stretch for compiling collections, in particular personalised collections.

The transport units are circulatory movable on the standby circulatory apparatus along a closed circulatory path. For this, the standby circulatory apparatus in particular includes a guide rail running along the circulatory path, for guiding the transport units.

The standby circulatory apparatus can be designed as a gravity conveyor. Gravity conveyors are characterised by at least one ascending stretch, along which the transport units via a drive are conveyed along the circulatory path from a lower position to a higher position. The gravity conveyor moreover includes at least one stretch with a descent, along which the transport units move by way of gravitational assistance.

The transport units in particular are designed as individual carriages. The transport units in particular include at least one roller, via which the individually carriages can roll along the aforementioned guide rail.

The transport units in particular each include a gripping element for holding the products. The gripping element, e.g., can be a clamp or a gripper.

The transport units can further include catch elements (catches), e.g. in the form of lugs, via which the transport units can be actively conveyed by way of a drive.

The transport units, for example, can be actively conveyed via the catch elements in the forced-conveying device which is yet described hereinafter.

If the standby circulatory apparatus is designed as a gravity conveyor, then the driver elements of a drive can actively convey the transport units upwards along the ascending stretch via their catch elements. The driver element establish a drive contact with the catch elements.

The provision conveyor serves for feed-conveying the products into the takeover section of the takeover station at the standby circulatory apparatus, where these are taken over by the transport units The provision conveyor in particular is designed for feed-conveying the products into the takeover section from below.

According to a further development of the invention, the provision conveyor includes a belt conveyor. The belt conveyor in particular is a double-belt conveyor. The products are conveyed in particular through the conveying gap of the double-belt conveyor from below into the takeover section of the takeover station.

A charging device can be assigned to the provision conveyor. The charging device can also be part of the provision conveyor. The charging device serves for charging (supplying) the provision conveyor with a stream of products from a store. The store, for example, can be a stack or a roll.

The products in the provision conveyor can be conveyed towards the standby circulatory apparatus in the form of an imbricate stream of products overlapping one another or in the form of a products stream of singularised products distanced to one another. A singularisation of the products with a view to the cycled takeover of individual products by the transport units can also already take place within the provision conveyor.

At the takeover station, the transport units take over the products, which are conveyed individually into the takeover section from the provision conveyor.

A positioning device by way of which the fed products are positioned with their leading product edge during the takeover can be provided in the takeover section. The positioning device can form a stop, on which the products come to abut with their leading product edge.

The positioning device in particular serves as an insert limitation. This means that the positioning device ensures a defined insert depth into the open gripping element.

In particular, the takeover station is designed such that the transport units are conveyed laterally into the takeover section.

The transport units are moved into the takeover section in a manner in which they are in particular above the products conveyed into the takeover section.

According to a further development of the invention, the takeover station includes at least one cam guide, by way of which the gripping element of a transport unit can be switched between an open position and closure position for the purpose of taking over the product.

The transfer of the products onto the transport units is effected in a cycled manner. This means that the products fed from the provision conveyor as well as the transport units are conveyed into the takeover section in a cycled manner.

According to a further development of the invention, the takeover station includes a forced-conveying device for this. The forced-conveying device is actively driven via a drive.

The forced-conveying device serves for conveying individual transport units at a predefined speed into the takeover section subsequently to the release device or its retaining element. The control of the drive is effected via the control device. The forced-conveying device permits the cycled conveying of transport units into the takeover section.

The conveying speed of the provision conveyor in particular is matched to the conveying speed of the forced-conveying device, in a manner such that a cyclically correct product of the provision conveyor and a transport unit of a takeover cycle are moved into the takeover section in a cyclically synchronous manner.

The drive of the provision conveyor and the drive of the forced-conveying device in particular are drive-coupled to one another for this. The coupling can be effected mechanically, e.g. by way of gears, or electronically, e.g. by way of the control device.

According to an embodiment variant, the forced-conveying device includes a transport screw, which is rotatable about a rotation axis. A spirally or helically designed guide groove is arranged along the outer periphery of the transport screw.

The guide groove serves for receiving a catch element, e.g. a lug, arranged on the transport unit. This catch element engages into the guide groove subsequently to the release device or its retaining element and together with the transport unit is caught along the rotation axis of the transport screw by the guide groove rotating with the transport screw, and conveyed into the takeover section.

The transport unit is conveyed out of the take-over section in conveying direction, subsequently to the takeover of the products in particular by the forced-conveying device.

The release device is arranged in front of the forced-conveying device considered in the circulatory direction. The release device on the one hand serves for releasing an single transport unit into the takeover section per takeover cycle. The release device, in cooperation with the control device moreover serves for releasing a transport unit only in those takeover cycles, in which a cyclically correct product is conveyed into the takeover section.

The release device in particular includes a retaining element, which can be switched by the control device and by way of which the transport units are held back in front of the takeover section considered in the circulating direction. Individual transport units can be released into the takeover section by way of switching the retaining element between a retaining position and a release position. The retaining element in particular can be switched pneumatically.

The standby circulatory apparatus in particular forms an accumulating stretch, which, considered in the circulatory direction, is in front of the retaining element and in which accumulating stretch the empty transport units are accumulated. The accumulating stretch in particular runs along a descent.

The empty transport units are transport units that are led back from the delivery station along the circulatory path in the circulating direction.

According to a further development of the invention, the standby circulatory apparatus includes a cycle take-up device, which takes the up conveying cycle from the forced-conveying device. The cycle take-up device in particular takes up (adopts) the conveying cycle, which is set by the rotary speed of a transport screw.

The cycle take-up device in particular serves for synchronising the conveying cycle of the provision conveyor with the conveying cycle of the force-conveying device.

The cycle receiver in particular moreover serves for synchronising the operating cycle of the release device with the conveying cycle of the forced-conveying device.

The standby circulatory apparatus moreover includes a delivery station which, considered in the conveying direction, is arranged after the takeover station. At the delivery station, the products are delivered from the transport units to a further-processing appliance.

According to a further development of the invention, the standby circulatory apparatus forms a buffer stretch between the takeover station and the delivery station. Consequently, the delivery station is arranged after the buffer stretch considered in the circulatory or conveying direction.

The delivery station can include a release device with a retaining element, which can be switched between a release position and a retaining position. Individual transport units can be released out of the buffer stretch by way of the release device, for the purpose of delivering the products to further-processing appliance. The delivery station or its release device in particular is controlled by the control device.

The transport units, which are charged with products, can be buffered in the buffer stretch. The buffer stretch can have a descent. The transport units can therefore moves along the buffer stretch towards the delivery station by way of gravitational assistance.

The operating cycle of the further-processing appliance, which takes over the products from the transport units of the standby circulatory apparatus at the delivery station, as a rule is decoupled from the takeover cycle of the takeover station or the standby circulatory apparatus.

The buffering of transport units with products then serves for ensuring an interruption-free supply of products to the further-processing appliance, which is in particular operated at a different operating cycle.

The degree of filling of the buffer stretch with transport units, according to a further aspect of the invention is monitored by the control device. For this, the standby circulatory apparatus includes means for the continuous detection of the number of transport units buffered in the buffer stretch.

The means in particular include a first buffer sensor arranged in front of the buffer stretch considered in the conveying direction, for counting the transport units moved into the buffer stretch.

The means in particular further include a second buffer sensor, which is arranged after the buffer stretch considered in the conveying direction, for counting the transport units moved out of the buffer stretch.

The degree of filling, i.e. the number of transport units that are currently held up in the buffer stretch can be determined in a continuous manner from the sensor data of the buffer sensors by way of an evaluation unit.

The sensor data or the filling degree information which is derived from this, in turn now serves for regulating the filling degree of the buffer stretch by way of the control device. The aim of the regulation of the filling degree is to ensure that a sufficient number of transport units with products is always located in the buffer stretch.

The precondition for this is that the feed appliance can be operated at a variable cycle rate (takeover cycle). The takeover cycle of the feed appliance is accordingly decoupled from the operating cycle of the further-processing appliance connecting to this feed appliance and can differ from this operating cycle.

The number of transport units with products in the buffer stretch can thus be increased in dependence on the filling degree, by way of increasing the takeover cycle rate of the feed appliance. An increase of the takeover cycle rate can be activated, for example, by the control device when this determines the falling-short of a lower filling degree threshold value.

On the other hand, the number of transport units with products in the buffer stretch can be reduced in dependence on the filling degree by way of reducing the takeover cycle rate of the feed appliance. A reduction of the takeover cycle rate can be activated, for example, by the control device if this ascertains an exceeding of an upper filling degree threshold value.

The provision of a gapless product stream, in which each product unit includes a product, necessitates faulty or incorrectly conveyed products being ejected out of the takeover section.

For this, the provision conveyor in particular includes an ejecting device, which ejects faulty products which are not taken over by a transport unit out of the takeover section.

According to a further development of the invention, the provision conveyor includes a sensor device for detecting the cyclically correct products, which are fed by this.

The sensor device in particular includes an optical sensor for monitoring or examining the product stream in the provision conveyor.

The sensor device, for example, can include a light barrier whose sensor detects the interruption of a measuring light beam. Light barriers in particular are suitable for monitoring a product stream of products, which are singularised and distanced to one another.

The sensor device can also include means for forming an illumination beam profile, which projects an illumination line onto the flat products. Such a sensor device in particular is applied for counting the products of an imbricate stream.

The illumination line, which is projected on the surface of the imbricate stream, is detected by way of an electronic camera and evaluated. The illumination line includes curvatures due to the imbricate structure of the product stream. The evaluation unit can individually recognise and count the products as well as any irregularities such as missing products or incorrectly conveyed products, from the curvatures.

Such a detection device is described, for example, in WO 2008/119192.

The sensor device, considered in the conveying direction, in particular is arranged in front of the conveying gap of a double-belt conveyor conveying the products into the takeover section from below.

The associated method according to the invention, according to an aspect of the invention is characterised in that individual transport units are released in a cyclically controlled manner by way of the release device and are moved cyclically synchronously with the individual products from the provision conveyor into the takeover section.

Hereby, it is only on feeding a cyclically correct product into the takeover section that a transport unit is released by the release device. By way of this, it is ensured that each transport unit takes over a cyclically correct product in the takeover section.

Accordingly, no transport unit is released by the release device on feeding an error product into the takeover section. Accordingly, no transport unit is moved into the takeover section in the takeover cycle of the error product.

The sensor data determined by the sensor device from the monitoring of the product stream is evaluated by way of an evaluation unit. The control device generates the respective control commands from the evaluated sensor data, for the release or non-release of a transport unit into the takeover section, for the purpose of taking-over a cyclically correct product.

If the sensor device detects a cyclically correct product, then the control device generates a control command to the release device for the release of the transport unit belonging to the cycle, at the point in time of the respective takeover cycle.

If in contrast the sensor device detects an error product, then the control device generates no control command to the release device for the release of the transport unit belong to the cycle, at the point in time of the respective takeover cycle. Accordingly, no transport unit is moved into the takeover section in the takeover cycle of the error product.

If error product is an empty cycle, then simply no transport unit with a product is released from the takeover section into the buffer stretch in the respective takeover cycle.

If the error product is a faulty product or an incorrectly conveyed product, then although this is conveyed into the takeover section, however it is not taken over by a transport unit there, since such a unit has not being released at this takeover cycle.

The error product, which is conveyed by the provision conveyor into the takeover section but which is not taken over, is rather ejected.

According to a further development of the invention, for this, the error product is moved against a deflector, which deflects this to the ejecting device. The deflector thereby in particular corresponds to the aforementioned positioning device for limiting the insert depth into the gripping element.

Since transport units with products are buffered in particular in a buffer stretch as mentioned above, the takeover cycle gaps, in which no products are taken over by transport units are only capable of influencing the degree of filling along the buffer stretch, but not the operating cycle of the subsequent further-processing appliance.

BRIEF DESCRIPTION OF THE DRAWINGS

The subject-matter of the invention is hereinafter explained in more detail by way of an embodiment example which is represented in the accompanying drawings. There are shown in.

Basically, the same parts in the figures are provided with the same reference numerals.

Figure 1:
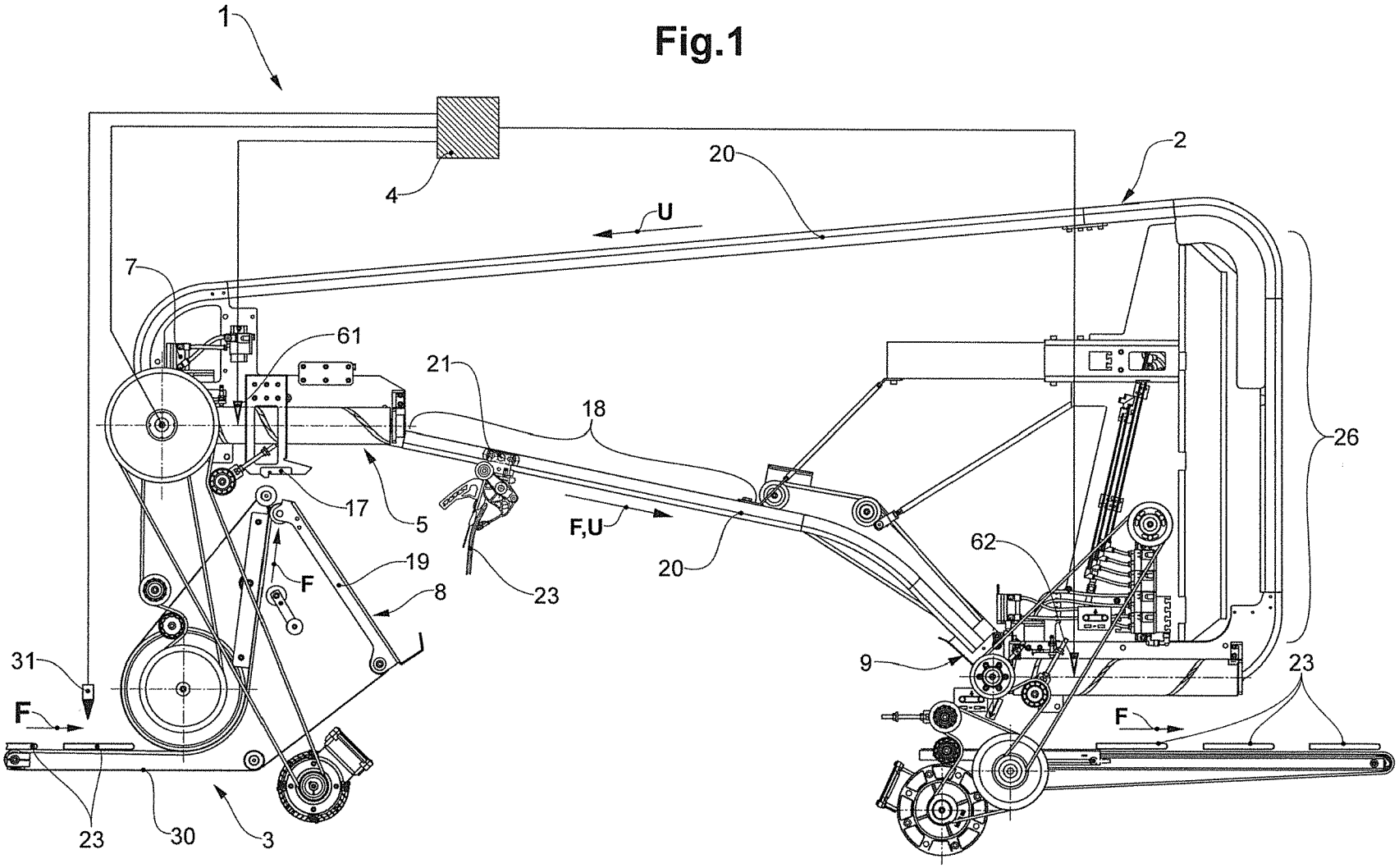
FIG. 1 is a lateral view of a feed appliance according to the invention.
Figure 5:
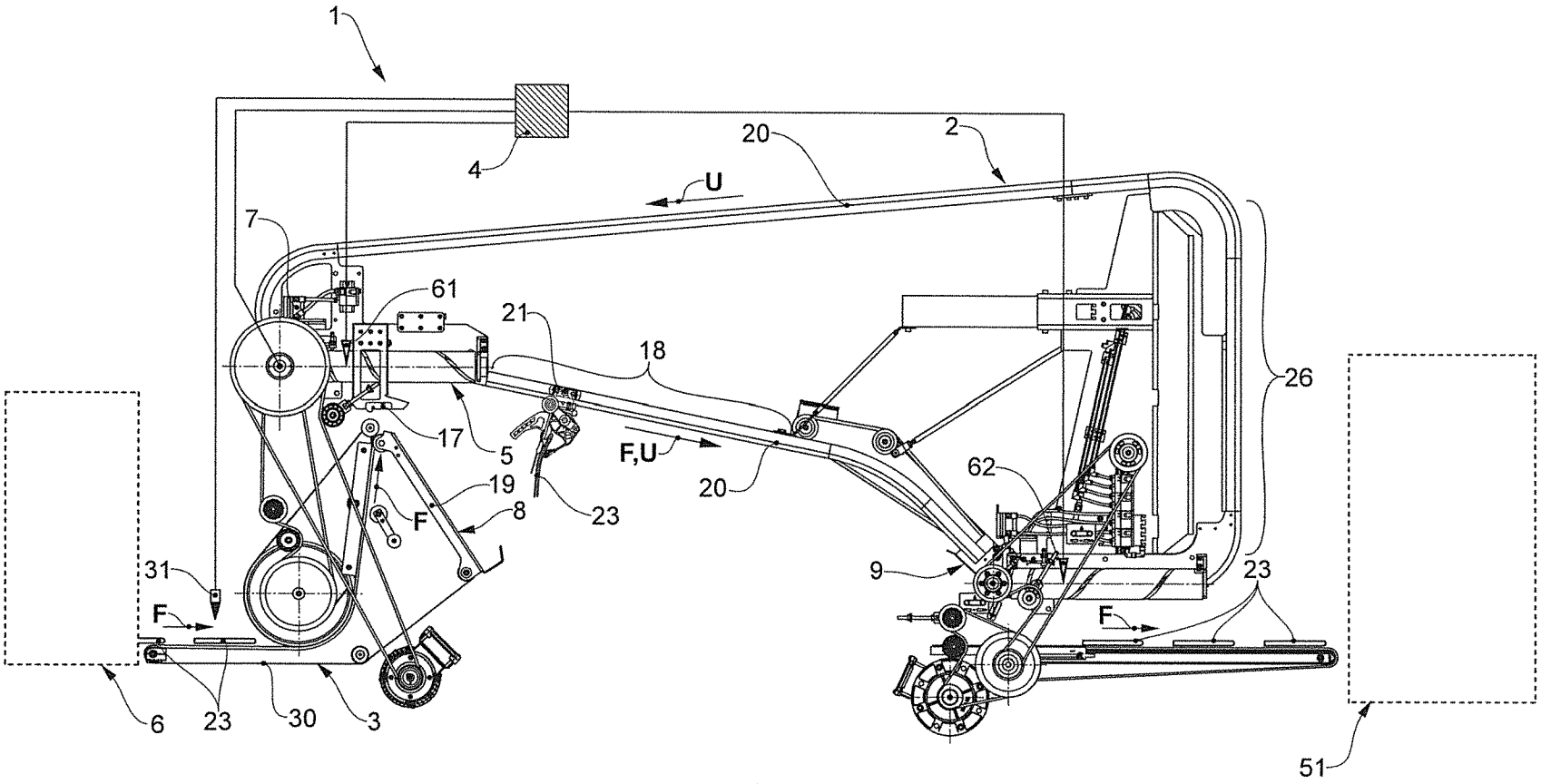
FIG. 5 is a lateral view of the feed appliance according to FIG. 1, with a charging device and with a further-processing appliance.

The feed appliance 1 according to FIGS. 1 and 5 includes a standby circulatory apparatus 2, which serves for creating a gapless stream of printed products 23 from individually feed printed products 23, for the transfer onto a further-processing appliance 51 connecting to the standby circulatory apparatus 2.

The standby circulatory apparatus 2 includes a plurality of transport carriages 21 which are circulatorily guided along a closed circulatory path. The transport carriages 21 include rollers, via which the transport carriages 21 roll along a guide rail 20. The guide rail 20 accordingly leads along the circulatory path U (see FIGS. 4*a* and 4*b*).

The transport carriages 21 each include a gripper 22 for the clamped holding of a printed product 23 in each case.

The standby circulatory apparatus 2 is designed as a gravity conveyor, in which the transport carriages 21, which are each movable along the guide rail 20 independently of one another, are conveyed upwards along an ascending stretch 26. For this, the transport carriages 21 include catching lugs 25, via which the transport carriages 21 are driven along the ascending stretch 26 by a driver with driver elements.

Departing from the upper, more highly situated end of the ascending path 26, the transport carriages 21 at least in sections by way of gravitational assistance roll along the conveying rail 20 having a descent at least in sections, back to the lower beginning of the ascending stretch 26 which is situated at a lower level.

The standby circulatory apparatus 2 moreover includes a takeover station 5, which forms the takeover section 12. The transport carriages 21 at the takeover station 5 each take over a printed product 23 delivered by a provision conveyor 3 into the takeover section 12.

The provision conveyor 3 includes a double-belt conveyor 30, by way of which the printed products are conveyed from below through a conveying gap into the takeover section 12 of the takeover station 5 (see FIG. 1 and FIG. 5).

A charging device 6 with a product store, from which the printed products 23 are fed to the double-belt conveyor 30 (see FIG. 5) can be assigned to the provision conveyor 3.

A positioning device 17 on which the printed products 23 fed from below abut with their leading product edge and thus positions the product with its leading edge is provided in the takeover section 12 of the standby circulatory apparatus 2. The positioning device 17 amongst other things serves as an insert limitation. This means that the positioning device 17 ensures a defined insert depth into the gripper 22.

Figure 2:
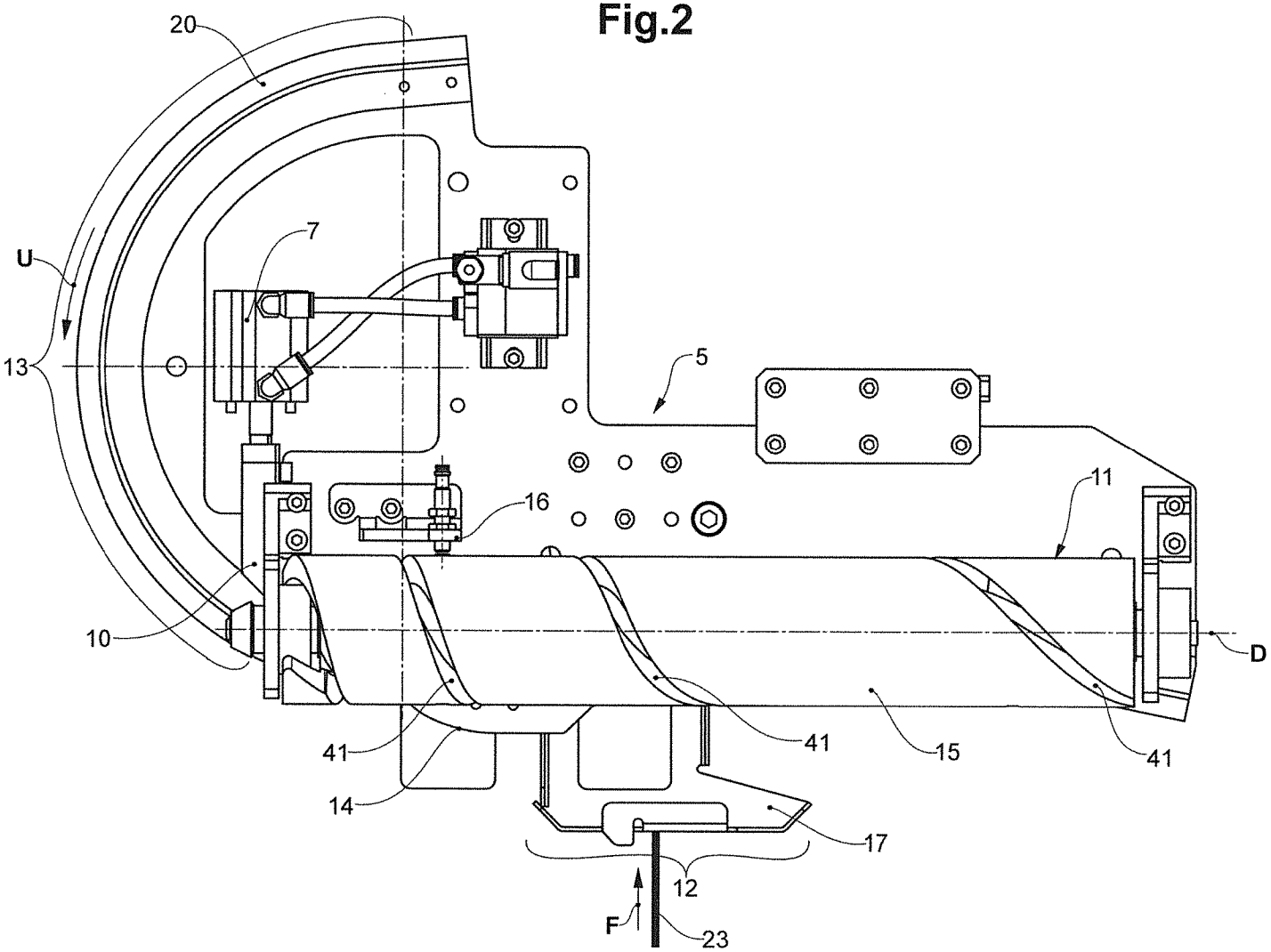
FIG. 2 is an enlarged detail of the takeover station according to FIG. 1.
Figure 3:
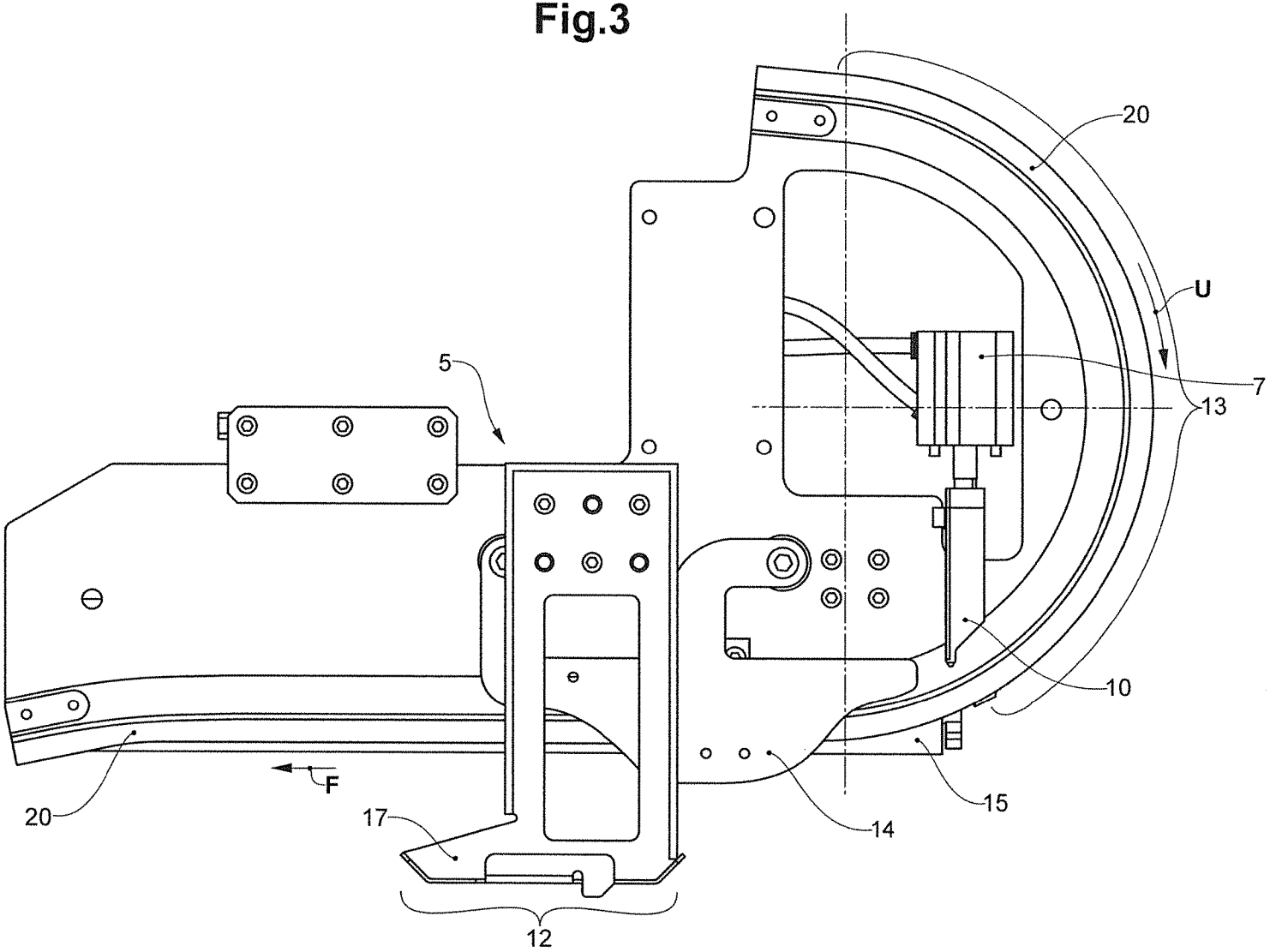
FIG. 3 is an enlarged detail of the takeover station according to FIG. 2, from the opposite side.

For this, the positioning device 17, considered in the conveying direction F, forms a stop on both sides of the guide rail 20 (see also FIGS. 2 and 3). However, only the stop lying behind the transport screw 15 in the conveying direction is represented in FIG. 2 for representational reasons.

The transport carriages 21 with their grippers are conveyed laterally into the takeover section 12. The transfer of the printed products 23 into the grippers 22 of the transport carriages 21 is effected in a cycled manner. Thereby, a printed product 23 is inserted from below into the open gripper 22 of the conveying carriage 21 moved cyclically synchronously into the takeover section 12.

The gripper 22, via a cam guide 14, is switched between an open position and closure position for taking over the printed product 23.

Since the takeover of the printed products 23 by the gripper 22 of the transport carriages 21 is effected in cycled manner, the printed products 23 as well as the transport carriages 21 must conveyed into the takeover section 12 in a cycled manner.

A transport screw 15 which is actively driven via a drive and which has a spirally designed guide groove 41 is provided for this. The control of the drive is effected via a control device 4.

The catching lug 25 of the transport carriage 21 engages into the guide groove 41 of the transport screw 15 and is caught by this, in an entry region at the end of the transport screw 15, which is at the front considered in the conveying direction. The transport carriage 21 is then transported via the catching lug 25 guided in the guide groove 41, along the transport screw 15 in the conveying direction F into the takeover section 12 in a cycled manner.

The conveying movement of the transport carriage 21 along the rotation axis D of the transport screw 15 is produced via the rotation movement of the transport screw 15 about its rotation axis D. The guide groove, which with this procedure quasi rotates about the rotation axis D, moves the catching lug 25 and, with this, the conveying carriage 21, in the conveying direction F.

The transport carriage 21 subsequently to the takeover of the printed product 23 by the transport screw 15 is conveyed further in the conveying direction F along the rotation axis of the screw out of the takeover section 12 again.

The catching lug 25 leaves the guide groove 41 again at the rear end of the transport screw 15. The transport carriage 21 merges into gravitation conveying along a conveying stretch with a descent which is subsequent to the transport screw 15.

The standby circulatory apparatus 2 moreover includes a release device 7 which considered in the circulatory direction U is arranged in front of the transport screw 15, i.e. in front of the takeover region 12. The release device 7 includes a retaining element 10, which can be switched between a retaining position and a release position and which in a retaining position holds back and accumulates the transport carriages 21 in front of the takeover section 12. The retaining element 10 holds back the transport carriage 21 on the catching lug 35.

The standby circulatory apparatus 2 forms a corresponding accumulating stretch 13, which is in front of the retaining element 10 considered in the circulatory direction U and in which the transport carriages 21 are accumulated. The accumulating stretch 13 forms a descent (see also FIG. 4*a*).

Individual transport vehicles 21 are released for the entry into the takeover section 12 by way of switching the retaining element 10 from the retaining position into the release position by way of the control device 4.

The retaining element 10 is switched by way of the control device 4 from the retaining position into the release position in each case, for releasing individual transport carriages 21 for the entry into the takeover region 12.

The released transport carriages 21 can move towards the entry region of the transport screw 15 in a manner assisted by gravity, at which entry region they are seized or gripped by the transport screw 15.

Figure 4A:
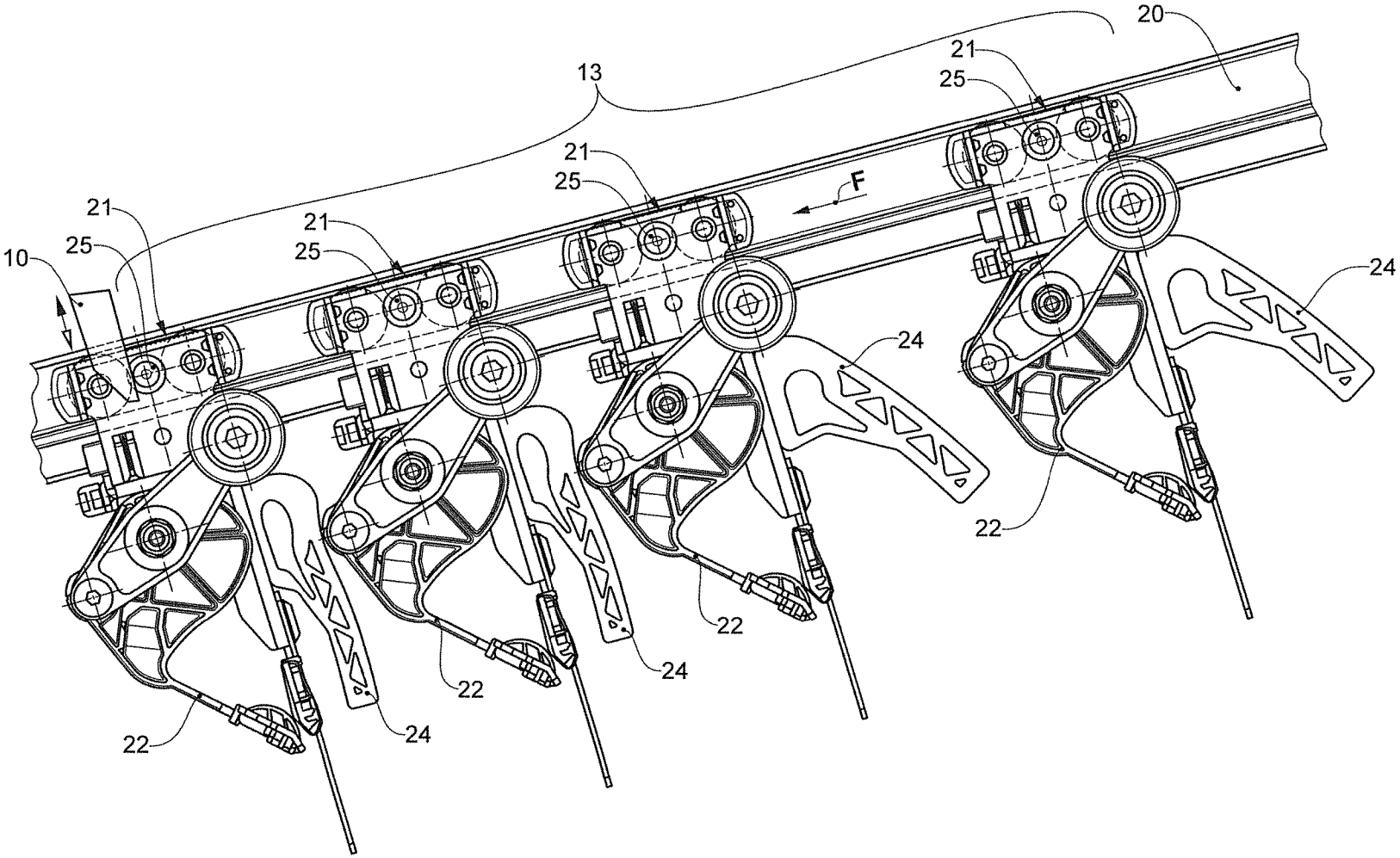
FIG. 4*a* is an enlarged detail of the accumulating stretch according to FIG. 1, with transport carriages.

The transport carriages 21 shown in FIG. 4*a* are each provided with an elastically deformable run-on element 24. This element is elastically deformed by the intrinsic weight of a subsequent transport carriage 21, which in the accumulating stretch 13 runs onto the frontmost transport carriage 21 held back by the retaining element 10.

If the frontmost transport carriage 21 is now released, then this repels itself from the trailing transport carriage 21 and thus obtains a movement impulse in the direction of the transport screw 15, due to the restoring of the run-on element 24 into its initial shape caused by relaxation.

In the present embodiment example, the retaining element 10 is switched pneumatically between the retaining position and release position.

The standby circulatory apparatus 2 moreover includes a cycle take-up device 16, which takes up the cycle of the actively driven transport screw 15. The conveying cycle of the provision conveyor 3 as well as the operating cycle of the release device 7 is synchronised with the conveying cycle of the transport screw 15, which is taken up by the cycle take-up device 16, by way of the control device 4.

Figure 4B:
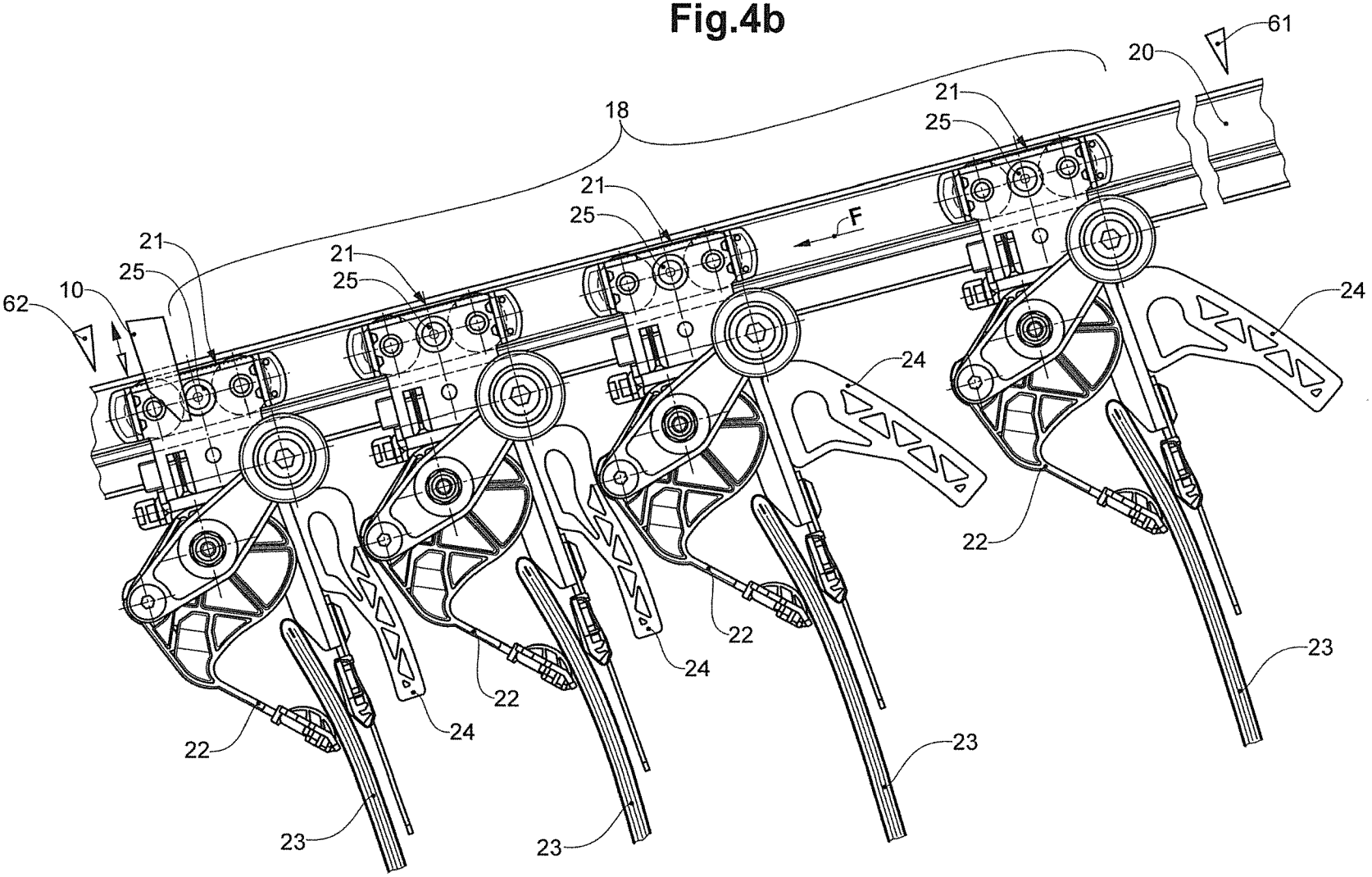
FIG. 4*b* is an enlarged detail of the buffer stretch according to FIG. 1, with transport carriages.

The standby circulatory apparatus 2 subsequently to the takeover station 5 forms a buffer stretch 18 in a stretch section having a descent, in which buffer stretch the transport carriages 21 fed with printed products 23 are buffered (see also FIG. 4*b*).

A delivery station 9 with a further release device including a retaining element 63 switchable between a retaining position and a release position is arranged at the end of the buffer stretch 18. The retaining element 63 is operated in the same manner as the retaining element 10 of the first release device which has already been described above.

The transport carriages 21 at the delivery station 9 can be released individually out of the buffer stretch and transferred to a further-processing appliance 51.

The transport carriages 21 released from the buffer stretch 18 can obtain a movement impulse in the direction of the delivery location via the elastically deformable run-on element 24 in the same manner as has been described above.

The printed products 23 are released at the delivery station 9 in a lower lying section of the circulatory path. The already mentioned ascending stretch 26, along which the empty transport carriages 21 are conveyed into a higher situated section of the circulatory path U for the purpose of leading back to the takeover station 5, is subsequent to the delivery station 9 considered in the circulatory direction U.

The buffering of transport carriages 21 with printed products 23 serves for ensuring an interruption-free supply of the further-processing appliance 51 operated with a different operating cycle, with printed products 23.

By way of the buffering of transport carriages 21 with printed products 23 along the buffer stretch 18, it is to be ensured that the interruption-free delivery of printed products 23 from the standby circulatory apparatus 2 to the further-processing appliance 51 on call or in the operating cycle of the further-processing appliance 51 is guaranteed, even given individual error products or ones occurring subsequent to one another, as is yet described hereinafter.

The degree of filling of the buffer stretch 18 with transport vehicles 21 is monitored by the control device 4. For this, a first buffer sensor 61 is arranged in front of the buffer stretch 18 and a second buffer sensor 62 after the buffer stretch 18. The first buffer sensor 61 serves for counting the transport carriages 21 entering into the buffer stretch 19 and the second buffer sensor 62 serves for counting the transport carriages 21 leaving the buffer stretch. The degree of filling, i.e. the number of transport carriages 21 currently located in the buffer stretch 18 can now be continuously determined from the sensor data of the buffer sensors 61, 62.

The feed appliance 1 is operated with a variable cycle rate for the control of the degree of filling of the buffer stretch 18.

As already mentioned above, given a constant delivery cycle rate—depending on the degree of filling of the buffer stretch 18—the number of transport carriages 21 in the buffer stretch 18 can be increased by way of increasing the takeover cycle rate of the feed appliance 1, or the number of transport carriages 21 in the buffer stretch 18 can be reduced by way of lowering the takeover cycle rate of the feed appliance.

The provision of a gapless product stream, with which each gripper 22 of a transport carriage 21 includes a printed product 23, necessitates only transport carriages 21 having a printed product 23 being fed to the buffer stretch 18. Faulty products are therefore ejected out in the takeover section and empty cycles without printed products 23 are left out.

For this, the provision conveyor 3 includes an ejecting device 8 with a slide 19 for ejecting faulty printed products 23, which are not taken over by a gripper 22 of a transport carriage 21, out of the takeover section 12 in a manner assisted by gravity.

For this, the provision conveyor 3 moreover includes a sensor device 31 for detecting cyclically correct products. The sensor device 31 in FIG. 1 is arranged, for example, in front of the conveying gap of the double-belt conveyor 30 considered in the conveying direction F.

If now a cyclically correct product is detected by the sensor device 31, then the control device 4 switches the retaining element 10 into the release position for the respective takeover cycle. Consequently, a transport carriage 21 is released into the takeover section at the respective takeover cycle.

If no cyclically correct product or an error product is detected at a conveying cycle, then the control device 4 does not switch the retaining element 10 into the release position for the respective takeover cycle. Consequently, also no transport carriage 21 is conveyed into the takeover section 12 at the respective takeover cycle If the error product is an empty cycle, then simply no transport vehicle 21 with a printed product 23 is released out of the takeover section 12 into the buffer stretch 18 in the respective operating cycle.

If the error product is faulty printed product 23, then although this is conveyed into the takeover section 12, there however it is not taken over by a transport carriage 21 since such has not been released.

The faulty printed product 23 which has not been taken over is however deflected downwards at the positioning device 17 and falls onto the slide 19 of the ejecting device 8, via which the faulty printed product 23 slides into a capture container. The positioning device 17 in this case also has the function of a deflector.

Thanks to the sensor device 31 for detecting cyclically correct printed products 23, it is ensured that a cyclically correct printed product 23 is always transferred onto the transport carriage 12 in the respective takeover cycles and released into the buffer stretch 18. Since a buffer of transport carriages 21 with printed products 23 is formed in the buffer stretch 18 as already mentioned above, the takeover gaps are only capable of influencing the degree of filling, but not the operating cycle of the subsequent further-processing appliance 51.

The invention claimed is:

1. A conveying system for a gapless feeding of products to a further-processing appliance, comprising:

a provision conveyor for feeding the products to a takeover station of a standby circulatory apparatus, the standby circulatory apparatus for taking over products from the provision conveyor and for conveying the products to the further-processing appliance, the standby circulatory apparatus comprising the takeover station and several transport carriages that are circulatorily movable independently of one another for each receiving a product at the takeover station from the provision conveyor, and a control device for controlling the feed of the products and of the transport carriages into a takeover section of the takeover station and for controlling the takeover of the products which are fed by the provision conveyor by the transport carriages, wherein the standby circulatory apparatus for creating a gapless product stream comprises a release device for the cyclically controlled release of individual transport carriages into the takeover section, wherein the control device is designed to release a transport carriage only given a feed of a cyclically correct product, which is correctly conveyed at a cycle of the provision conveyor into the takeover section.

2. The conveying system according to claim 1, wherein the takeover station comprises a forced-conveying device that can be driven by a drive, for moving the transport carriage from the release device into the takeover section at a predefined speed.

3. The conveying system according to claim 2, wherein the forced-conveying device comprises a transport screw that is rotatable about a rotation axis, for moving the transport carriage along the rotation axis of the transport screw.

4. The conveying system according to claim 2, wherein the standby circulatory apparatus comprises a cycle take-up device that takes up a conveying cycle of the forced-conveying device.

5. The conveying system according to claim 1, wherein the takeover station comprises a positioning device for positioning the leading edge of the products conveyed by the provision conveyor into the takeover section, during the takeover by the transport carriage.

6. The conveying system according to claim 1, wherein the provision conveyor comprises a belt conveyor, by way of which the products are conveyed to the takeover station.

7. The conveying system according to claim 1, wherein the provision conveyor comprises a sensor device for detecting products.

8. The conveying system according to claim 1, wherein the transport carriages each comprise a gripping element for holding the products.

9. The conveying system according to claim 8, wherein the takeover station comprises at least one cam guide for switching the gripping elements of the transport carriages, which are moved through the takeover section, between an open position and a closure position.

10. The conveying system according to claim 1, wherein the standby circularly apparatus forms an accumulating stretch, which is in front of the release device considered in the circulatory direction, for accumulating the transport carriages.

11. The conveying system according to claim 1, wherein the drive of the provision conveyor and of the forced-conveying device are coupled to one another.

12. The conveying system according to claim 1, wherein a delivery station for delivering the products to the further-processing appliance is arranged on the standby circulatory apparatus in a manner subsequent to the takeover station considered in the circulatory direction.

13. The conveying system according to claim 1, wherein the release device comprises a retaining element, which can be switched by the control device and by way of which the transport carriages can be held back in front of the takeover section considered in the circulatory direction, and individually released into the takeover section.

14. A conveying system for a gapless feeding of products to a further-processing appliance, comprising:

a provision conveyor for feeding the products to a takeover station of a standby circulatory apparatus, the standby circulatory apparatus for taking over products from the provision conveyor and for conveying the products to the further-processing appliance, the standby circulatory apparatus comprising the takeover station and several transport carriages that are circulatorily movable independently of one another, for each receiving a product at the takeover station from the provision conveyor, and a control device for controlling the feed of the products and of the transport carriages into a takeover section of the takeover station and for controlling the takeover of the products which are fed by the provision conveyor by the transport carriages, wherein the standby circulatory apparatus forms a buffer stretch that is subsequent to the takeover station considered in the circulatory direction, for buffering transport carriages charged with products, wherein the conveying system comprises a detection device for the continuous detection of the number of transport carriages buffered in the buffer stretch.

15. A method for creating a gapless product stream with a conveying system according to claim 14, comprising the steps of:

releasing individual transport carriages in a cyclically controlled manner by way of the release device and moving the individual transport carriages in a cyclically synchronous manner with the individual products which are fed by the provision conveyor into the takeover section, wherein a transport carriage is released by the release device only on feeding a cyclically correct product which is correctly conveyed at a cycle of the provision conveyor into the takeover section.

16. The method according to claim 15, wherein a cyclically correct product in the provision conveyor is detected by way of a sensor device and the control device consequently produces a control command for the release of a transport carriage at a cycle which corresponds to the takeover cycle at which the detected, cyclically correct product is taken over at the takeover station.

17. The method according to claim 15, wherein a product and a transport carriage of a takeover cycle are each conveyed into the takeover section in a cyclically synchronous manner.

18. The method according to claim 15, wherein the takeover station comprises a forced-conveying device that can be driven by a drive, for moving the transport carriage from the release device into the takeover section at a predefined speed, and a switching cycle of the release device at which the products are released by the release device is synchronised with the cycle of the forced-conveying device which is taken up by the cycle take-up device.

19. The method according to claim 18, wherein the conveying cycle of the provision conveyor is synchronised the cycle of the forced-conveying device, which is taken up by cycle take-up device.

20. A method for creating a gapless product stream with a conveying system according to claim 14, comprising the steps of:

continuously detecting the number of transport carriages buffered in the buffer stretch by the detection device, and regulating and controlling the degree of filling of the buffer stretch by the control device based on measurement results of the detection device.

21. The method according to claim 20, wherein the control device increases a product takeover cycle rate of conveying system on falling short of a lower filling degree threshold and reduces a product takeover cycle rate on exceeding an upper filling degree threshold.

* * * * *